US005840122A

United States Patent [19]

Williams

[11] Patent Number: 5,840,122

[45] Date of Patent: Nov. 24, 1998

[54] DOOR KNOB COVER

[76] Inventor: Dennis C. Williams, 2426 Clearbrook Dr., Missouri City, Tex. 77459

[21] Appl. No.: 840,990

[22] Filed: Apr. 25, 1997

[51] Int. Cl.[6] ..... B05C 11/11

[52] U.S. Cl. ..... 118/505; 16/DIG. 2

[58] Field of Search ..... 16/DIG. 2, 121, 16/118; 70/455; 150/155; 292/DIG. 2; D8/322; 74/558.5; 118/504, 505

[56] References Cited

U.S. PATENT DOCUMENTS

| | | | |
|---|---|---|---|
| 853,537 | 5/1907 | Dubisee . | |
| 1,633,988 | 6/1927 | Jones | 150/155 |
| 2,721,597 | 10/1955 | Pitrella | 150/155 |
| 4,695,486 | 9/1987 | Stark | 16/DIG. 2 |
| 4,856,140 | 8/1989 | Visco et al. | 150/155 |
| 5,008,551 | 4/1991 | Randolph | 16/121 |

*Primary Examiner*—Brenda A. Lamb

[57] ABSTRACT

A cover for enclosing a door knob during painting of a door. The inventive device includes a spherical resilient knob cover assembly positionable over a knob portion of a door knob. An escutcheon cover assembly extends from the knob cover assembly for positioning over an escutcheon and shaft of the door knob.

1 Claim, 4 Drawing Sheets

FIG 7
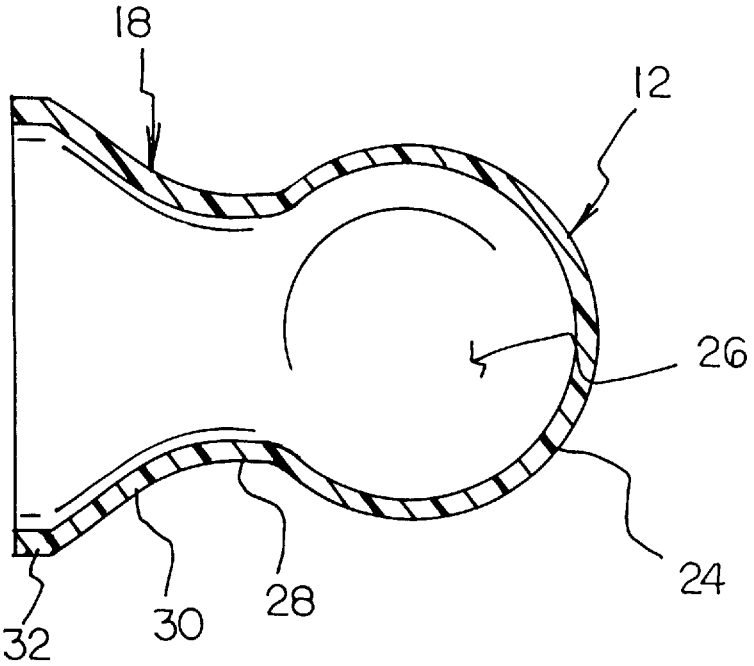
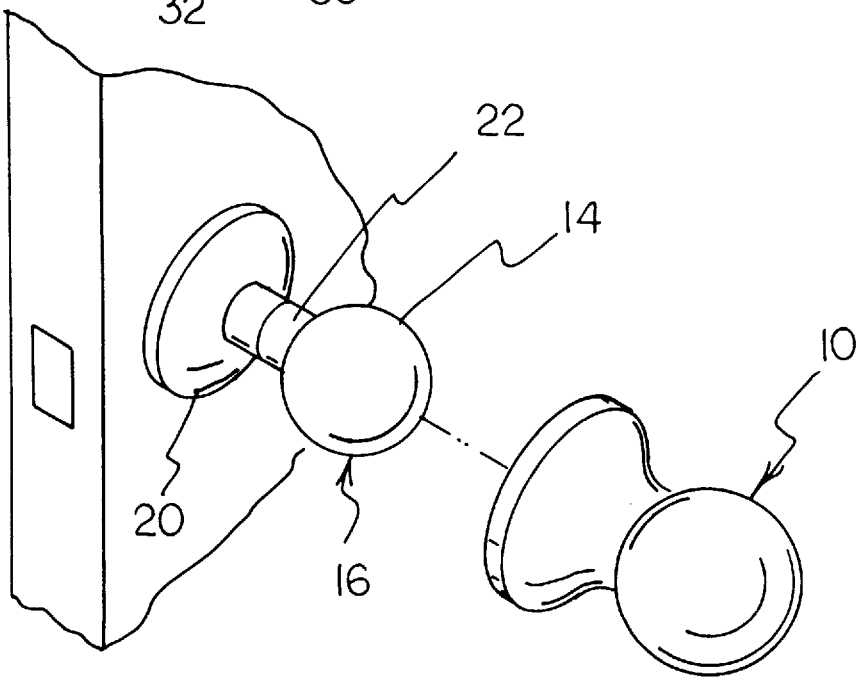
FIG 8

DOOR KNOB COVER

BACKGROUND OF THE INVENTION

1. Field of the Invention

The present invention relates to covering devices and more particularly pertains to an door knob cover for providing a unique coupling with a door knob so as to enclose the door knob during painting of an associated door.

2. Description of the Prior Art

The use of covering devices is known in the prior art. More specifically, covering devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art covering devices include U.S. Pat. No. 3,722,470 to Farrell; U.S. Pat. No. 4,327,663 to Izzo; U.S. Pat. No. 4,695,496 to Stark; and U.S. Pat. No. 4,656,058 to Stark.

The devices disclosed in such patents all teach a similar method of maintaining a coupling between a door knob and a door knob paint protection cover. Each relies solely on a frictional engagement between the outer rim of a base of the door knob and the cover. Such outer rim is notoriously thin thereby affording a flimsy coupling between the door knob and the door knob cover. Further such door knob covers are bulky thus creating an obstruction during the painting of the door.

While the aforementioned devices fulfill their respective, particular objectives and requirements, the aforementioned patents do not disclose a door knob cover for enclosing a door knob during painting of a door which includes a spherical resilient knob cover assembly positionable over a knob portion of a door knob, and an escutcheon cover assembly extending from the knob cover for positioning over an escutcheon and shaft of the door knob.

In these respects, the door knob cover according to the present invention substantially departs from the conventional concepts and designs of the prior art, and in so doing provides an apparatus primarily developed for the purpose of enclosing a door knob during painting of a door.

SUMMARY OF THE INVENTION

In view of the foregoing disadvantages inherent in the known types of covering devices now present in the prior art, the present invention provides a new door knob cover construction wherein the same can be utilized for enclosing a door knob. As such, the general purpose of the present invention, which will be described subsequently in greater detail, is to provide a new door knob cover apparatus and method which has many of the advantages of the covering devices mentioned heretofore and many novel features that result in a door knob cover which is not anticipated, rendered obvious, suggested, or even implied by any of the prior art covering devices, either alone or in any combination thereof.

To attain this, the present invention generally comprises a cover for enclosing a door knob during painting of a door. The inventive device includes a spherical resilient knob cover assembly positionable over a knob portion of a door knob. An escutcheon cover assembly extends from the knob cover assembly for positioning over an escutcheon and shaft of the door knob.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved door knob cover which has all the advantages of the prior art covering devices and none of the disadvantages.

It is another object of the present invention to provide a new and improved door knob cover which may be easily and efficiently manufactured and marketed.

It is a further object of the present invention to provide a new and improved door knob cover which is of a durable and reliable construction.

An even further object of the present invention is to provide a new and improved door knob cover which is susceptible of a low cost of manufacture with regard to both materials and labor, and which accordingly is then susceptible of low prices of sale to the consuming public, thereby making such door knob cover economically available to the buying public.

Still yet another object of the present invention is to provide a new and improved door knob cover which provides in the apparatuses and methods of the prior art some of the advantages thereof, while simultaneously overcoming some of the disadvantages normally associated therewith.

Still another object of the present invention is to provide a unique coupling with a door knob so as to enclose the door knob during painting of an associated door.

Another object of the present invention is to provide a paint protection door knob cover which is washable.

Lastly, it is an object of the present invention to provide a new and improved cover for enclosing a door knob during painting of a door. The inventive device includes a spherical resilient knob cover assembly positionable over a knob portion of a door knob. An escutcheon cover assembly extends from the knob cover assembly for positioning over an escutcheon and shaft of the door knob.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a cross sectional view taken along line 7—7 of FIG. 6.

FIG. 8 is an exploded isometric illustration of the door knob cover illustrating in placement thereof over a door knob.

DESCRIPTION OF THE PREFERRED EMBODIMENT

Figure 1:
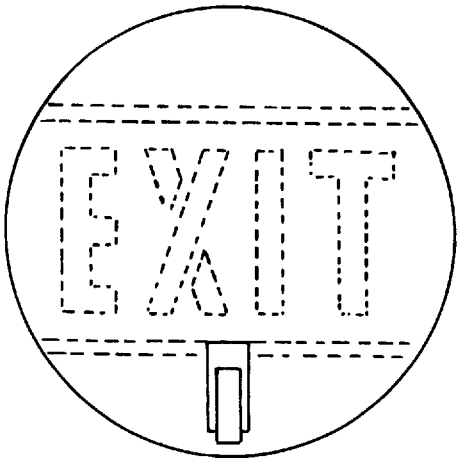
FIG 1 PRIOR ART
FIG. 1 is a front elevation view of a prior art covering device.

With reference now to the drawings, and in particular to FIGS. 3–8 thereof, a new door knob cover embodying the principles and concepts of the present invention and generally designated by the reference numeral 10 will be described.

Figure 2:
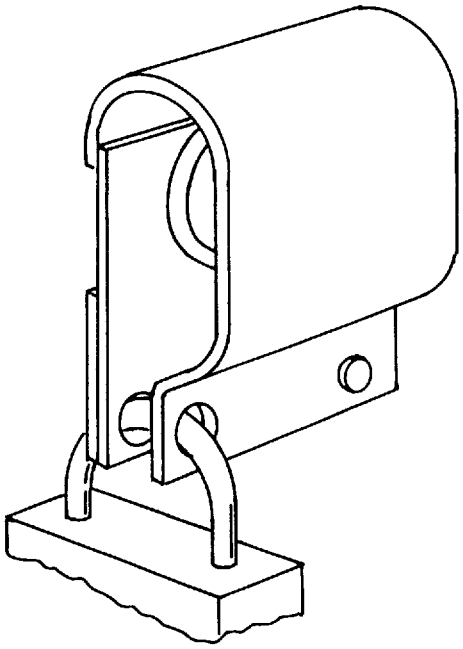
FIG 2 PRIOR ART
FIG. 2 is an isometric illustration of a further prior art covering device.
Figure 3:
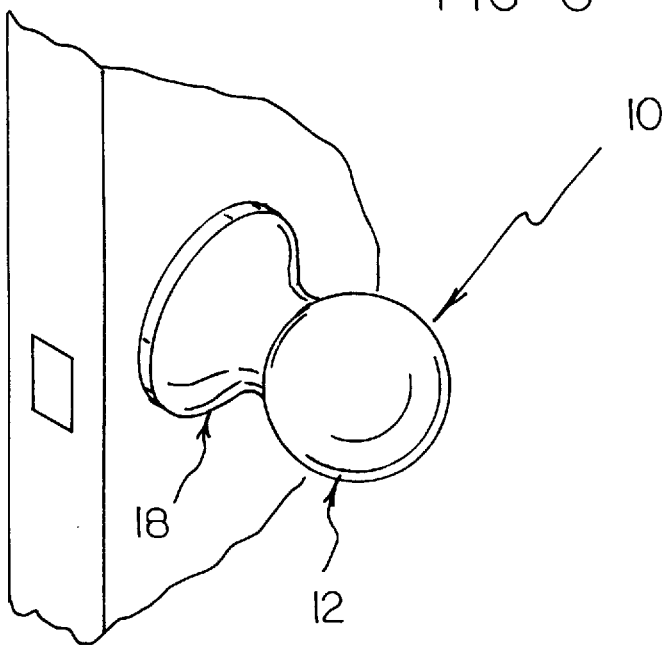
FIG. 3 is an isometric illustration of a door knob cover according to the present invention is use.
Figure 4:
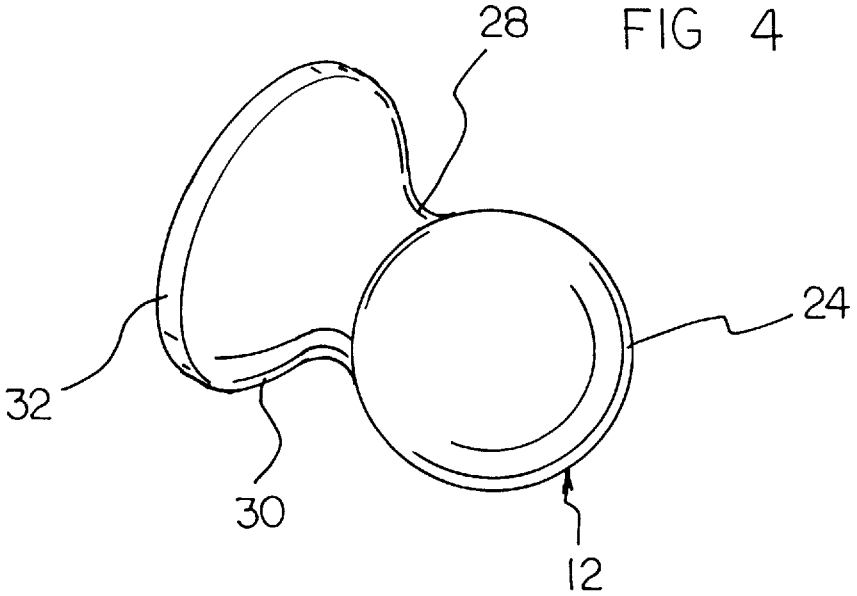
FIG. 4 is an isometric illustration of the invention, per se.
Figure 5:
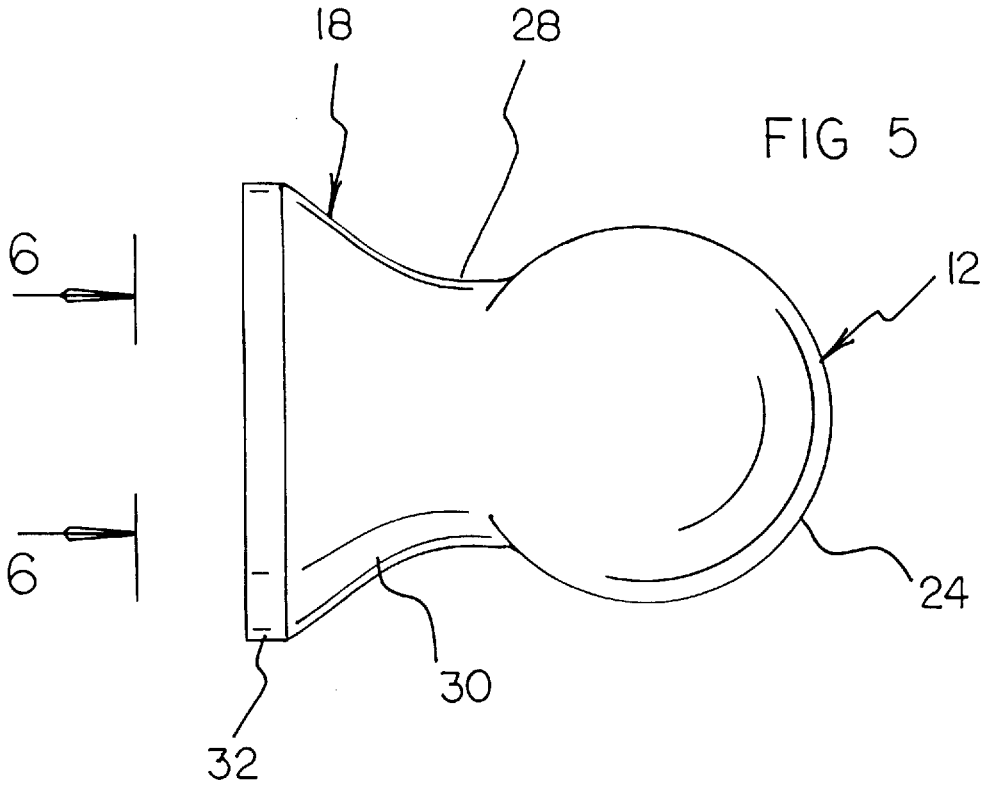
FIG. 5 is a side elevation view of the invention.
Figure 6:
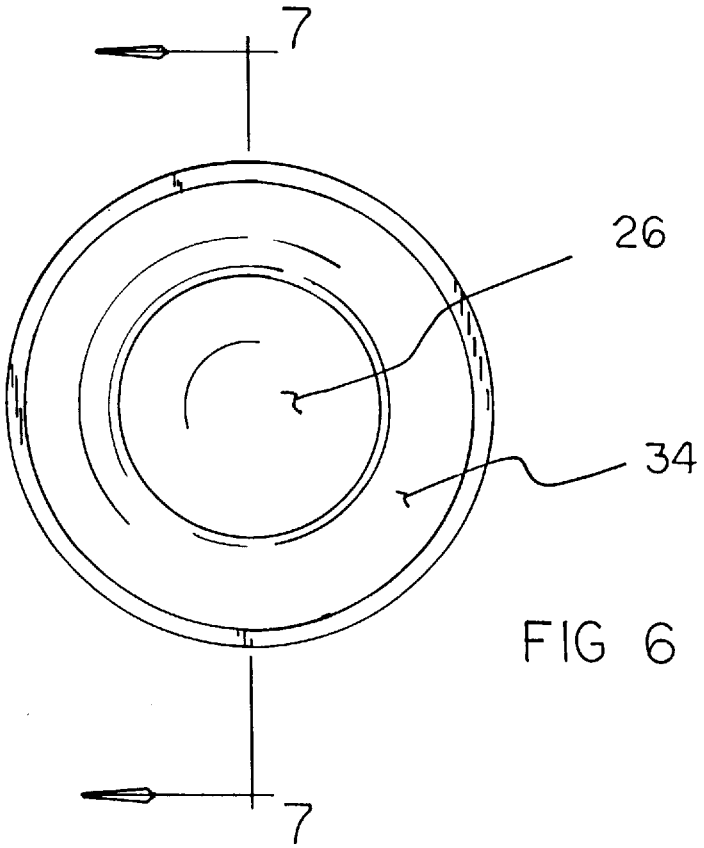
FIG. 6 is an end elevation view taken from line 6—6 of FIG. 5.

Turning initially to FIGS. 1 and 2 wherein prior art covering devices are illustrated, it can be shown that the prior art discloses a substantially rectangular covering device, as shown in FIG. 1, or a lockable covering device as shown in FIG. 2.

Referring now to FIGS. 3 through 8 wherein the present invention 10 is illustrated in detail, it can be shown that the door knob cover 10 comprises a knob cover means 12 for positioning over a spherical knob portion 14 of a door knob 16, as shown in FIG. 8 of the drawings. An escutcheon cover means 18 extends from the knob cover means 12 for positioning over an escutcheon portion 20 and shaft portion 22 of the door knob 16. By this structure, the door knob 16 can be protected from receiving a coat of paint during painting of the associated and unlabeled door.

As best illustrated in FIGS. 4 through 7, it can be shown that the knob cover means 12 according to the present invention 10 preferably comprises a substantially spherical envelope 24 formed of a resilient material. As shown in FIG. 7, the spherical envelope 24 defines a knob cavity 26 within which the spherical knob portion 14 of a door knob 16 can be received. By this structure, the spherical envelope 24 of the knob cover means 12 can be resiliently deformed so as to permit insertion of the spherical knob portion 14 into the knob cavity 26, whereby resilient contraction of the spherical envelope 24 about the spherical knob portion 14 of the door knob 16 secures the knob cover means 12 over the spherical knob portion of the door knob in a sturdy fashion.

With continuing reference to FIGS. 4 through 7, it can be shown that the escutcheon cover means 18 according to the present invention 10 comprises a cylindrical neck portion 28 projecting from an annular opening directed through the spherical envelope 24 of the knob cover means 12. The cylindrical neck portion 28 continues into a truncated conical neck portion 30 projecting from the knob cover means 12 and increasing in diameter relative to the cylindrical neck portion 28. To this end, the truncated conical neck portion 30 is of a first diameter at a juncture of the cylindrical neck portion 28 and the truncated conical neck portion 30 and tapers to a second diameter spaced from the junction of the cylindrical neck portion and the truncated conical neck portion 30, wherein the second diameter is substantially greater than the first diameter to define the truncated conical shape of the truncated conical neck portion 30. The escutcheon cover means 18 further comprises a cylindrical portion 32 projecting from the truncated conical neck portion 30. Accordingly, the cylindrical portion 32 is of the second diameter of the spaced end of the truncated conical neck portion 30 relative to the juncture of the cylindrical neck portion 28 and the truncated conical neck portion as described above. By this structure, the shaft portion 22 of the door knob 16 can be received within the cylindrical neck portion 28 of the escutcheon cover means 18, with the truncated conical neck portion 30 and the cylindrical portion 32 of the escutcheon cover means cooperating to effect coextensive enclosure of the escutcheon portion 20 of the door knob 16. As shown in FIG. 7, the escutcheon cover means 18 is preferably integrally formed with the knob cover means 12 such that the device 10 may be formed during a single molding operation. The escutcheon cover means 18 is further similarly comprised of a substantially resilient material, wherein the escutcheon cover means can be expanded during placement of the device 10 onto a door knob 16 such that resilient contraction of the escutcheon cover means 18 provides a snug fit of the escutcheon cover means around the escutcheon portion 20 of the door knob 16. Thus, the truncated conical neck portion 30 and the cylindrical portion 32 cooperate to define an escutcheon cavity 34 within which the escutcheon portion 20 of the door knob 16 can be received.

In use, the door knob cover 10 according to the present invention can be easily positioned over a door knob 16 prior to a painting procedure being preformed upon the door to which the door knob is attached. The device 10 thus precludes paint from being undesirably applied to the door knob 16 and substantially expedites a masking procedure of the door knob prior to painting of the door. Thus, the device 10 substantially reduces an amount of time required to effect painting of a door.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A door knob cover comprising:

a knob cover means for positioning over a spherical knob portion of a door knob, wherein the knob cover means comprises a substantially spherical envelope formed of a resilient material, the spherical envelope defining a knob cavity within which a spherical knob portion of a door knob can be received, the spherical envelope of the knob cover means capable of being resiliently deformed so as to permit insertion of the spherical knob portion of the door knob into the knob cavity with a resilient contraction of the spherical envelope about the spherical knob portion of the door knob operating to secure the knob cover means over the spherical knob portion of the door knob;

an escutcheon cover means integrally formed with the knob cover means and extending from the knob cover means for positioning over an escutcheon portion and shaft portion of the door knob, wherein the escutcheon cover means comprises a cylindrical neck portion projecting from an annular opening directed through the spherical envelope of the knob cover means, the cylindrical neck portion continuing into a truncated conical neck portion projecting from the knob cover means and increasing in diameter relative to the cylindrical neck portion such that the truncated conical neck portion is of a first diameter at a juncture of the cylindrical neck portion and the truncated conical neck portion and tapers to a second diameter spaced from the junction of the cylindrical neck portion and the truncated conical neck portion, wherein the second diameter is substantially greater than the first diameter to define the truncated conical shape of the truncated conical neck portion;

said escutcheon cover means further comprising a cylindrical portion projecting from the truncated conical neck portion, diameter of the cylindrical portion equal to the second diameter such that the shaft portion of the door knob can be received within the cylindrical neck portion of the escutcheon cover means, with the truncated conical neck portion and the cylindrical portion of the escutcheon cover means cooperating to effect coextensive enclosure of an escutcheon portion of the door knob;

said escutcheon cover means comprised of a substantially resilient material, wherein the escutcheon cover means can be expanded during placement of the door knob cover onto a door knob such that resilient contraction of the escutcheon cover means provides frictional engagement of the escutcheon cover means around the escutcheon portion of the door knob.

* * * * *